US007686742B2

(12) United States Patent
Tischler et al.

(10) Patent No.: US 7,686,742 B2
(45) Date of Patent: Mar. 30, 2010

(54) EXERCISE DESK

(75) Inventors: Ruth Louise Tischler, 302 Baptiste Ave., Monroe, MI (US) 48162; Scott Richard Goocher, Flatrock, MI (US)

(73) Assignee: Ruth Louise Tischler, Monroe, MI (US)

( * ) Notice: Subject to any disclaimer, the term of this patent is extended or adjusted under 35 U.S.C. 154(b) by 1246 days.

(21) Appl. No.: 10/908,675

(22) Filed: May 23, 2005

(65) Prior Publication Data

US 2006/0264306 A1 Nov. 23, 2006

(51) Int. Cl.
*A63B 22/06* (2006.01)

(52) U.S. Cl. ..... 482/57; 108/8

(58) Field of Classification Search ..... 482/51, 482/52, 57, 61, 62, 148, 904; 108/9, 10, 108/12, 44, 116, 137, 141, 145, 147.19, 89; D6/406.1, 406.2; 211/119.005
See application file for complete search history.

(56) References Cited

U.S. PATENT DOCUMENTS 2,535,112 A * 12/1950 Woody ..... 312/233
5,257,701 A 11/1993 Edelson ..... 211/149
5,813,947 A 9/1998 Densmore ..... 482/51
6,283,047 B1 9/2001 Haller ..... 108/145
6,722,290 B2 4/2004 Wetterlund ..... 108/44
6,945,917 B1 * 9/2005 Baatz ..... 482/63
7,115,074 B2 * 10/2006 Wu ..... 482/51
2003/0008752 A1 * 1/2003 Hsu ..... 482/55
2006/0258513 A1 * 11/2006 Routley et al. ..... 482/54

* cited by examiner

*Primary Examiner*—Loan H Thanh
*Assistant Examiner*—Tam Nguyen
(74) *Attorney, Agent, or Firm*—Mitchell M. Musial, II PLLC

(57) ABSTRACT

An exercise desk that may be attached to a piece of exercise equipment is disclosed that that has an adjustable desk top. By providing an adapter capable of independent adjustment of the desk top, horizontal position of the adapter and vertical position of the adapter, the exercise desk may be mounted to a variety of exercise devices. Furthermore, the desk top is selectively pivotable.

2 Claims, 4 Drawing Sheets

EXERCISE DESK

FIELD OF THE INVENTION

The present invention relates to an attachable desk, and more specifically, to a desk that is attachable to exercise equipment.

BACKGROUND OF THE INVENTION

The mental and physical health benefits of exercise are well known. The physical benefits include reduced risk of heart disease and high blood pressure. Additionally, long hours spent working at a desk or studying may be harmful. It has been shown that not moving while working or studying at a desk may cause postural fixity, which is the static loading of the musculoskeletal system. Postural fixity may cause back, neck, shoulder and other pain.

The mental health benefits of exercise include reduced depression and anxiety and improved psychological well-being. Additionally, it is believed that exercise provides benefits for individuals with learning disabilities. More specifically, it is believed that physical exercise permits those persons with learning disabilities to concentrate better.

There are a number of inventions known in the art that provide for the ability to study or work while exercising. One such device is disclosed in U.S. Pat. No. 5,813,947. The '947 patent discloses an exercise desk that enables a user to exercise on an exercise device while carrying out unrelated activities, such as working, by providing a work surface for supporting articles used in such activities. The exercise desk serves as an enclosure for storing the exercise device out of sight when it is not in use and has the look and finish of fine furniture. Additionally, the exercise desk can serve as an upright desk when the user is not exercising. However, one disadvantage of the '947 patent is that it does not have an adjustable desk top. Furthermore, the desk does not attach directly to the exercise equipment, which could create stability problems.

U.S. Pat. No. 5,257,701 discloses a collapsible desk with unique height adjustment features which allow users to change positions frequently and exercise while they work. However, one disadvantage of the '701 patent is that it does not attach directly to the exercise equipment. Furthermore, the desk does not provide a means to adjust the incline of the desk top.

Thus, it is desirable to provide an exercise desk that may be attached to a piece of exercise equipment. It is also desirable to provide an exercise desk that that has an adjustable desk top.

SUMMARY OF THE INVENTION

An exercise desk for attaching to an exercise device comprises a base for providing support to the exercise desk and a desk top that provides a stable surface. A selectively pivotable desk mount is fixedly attached to the desk top to permit the desk top to pivot about an axis. A desk top positioning system is selected from the group consisting of an orthogonal positioning system and a triangular positioning system, where the positioning system is attached to the desk mount to permit independent vertical and horizontal positioning of the desk top. The positioning system is further attached to the exercise device at least at one point.

An orthogonal positioning system includes an adapter having a vertical desk adjustment, a vertical attachment adjustment and a horizontal attachment adjustment enables the desk top to be positioned independent of the vertical attachment adjustment and horizontal attachment adjustment. An attachment member is provided for securing the exercise desk to the exercise device. At least one desk top support member is disposed between the adapter and the desk mount provides vertical adjustment to the desk top. The exercise desk includes at least one vertical support member disposed between the base and the adapter to provide vertical adjustment for the attachment member. At least one horizontal support member disposed between the adapter and the attachment member provides horizontal adjustment for the attachment.

A triangular positioning system includes a generally vertical support member slidably engaging a vertical desk top support member. The desk top support member is selectively adjustable along the long axis of the vertical support member by a vertical attachment adjustment. An inclined support member slidably engages an inclined desk top support member. The inclined desk top support member is selectively adjustable along the long axis of the inclined support member by an inclined attachment adjustment. The vertical support member is attached to one either a base or the exercise device and the inclined support member is attached to the exercise device.

The exercise desk may be employed with a bicycle. Additionally, a rear wheel support device may be employed to maintain a vertical clearance between a rear wheel of the bicycle and a support surface, the rear support device having a load device to apply resistance against the petals.

Further objects, features and advantages of the present invention will become apparent to those skilled in the art from analysis of the following written description, the accompanying drawings and the appended claims.

DESCRIPTION OF THE PREFERRED EMBODIMENT

Figure 1:
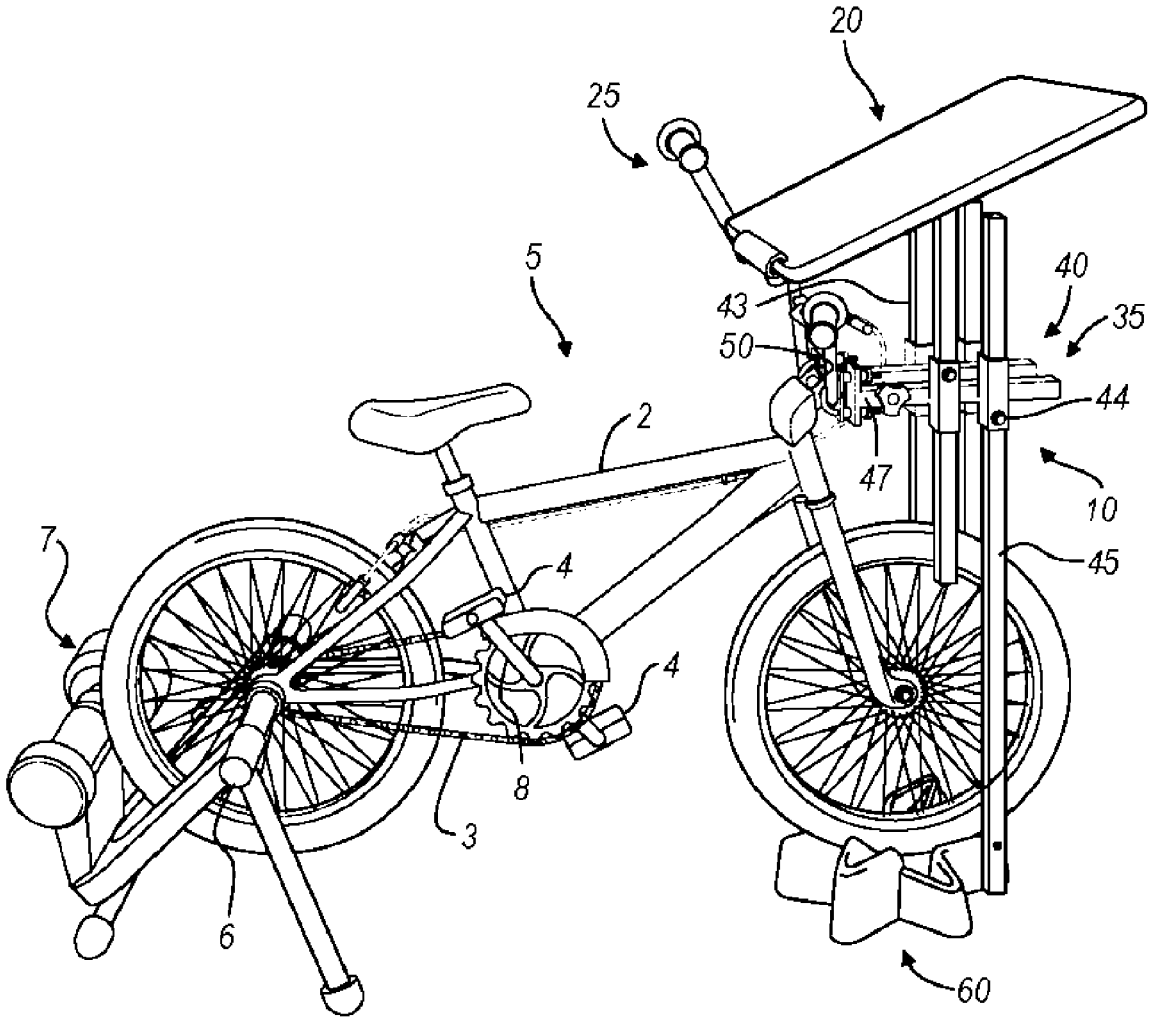
FIG. 1 is a perspective view of an exercise desk according to the principles of the present invention.
Figure 2:
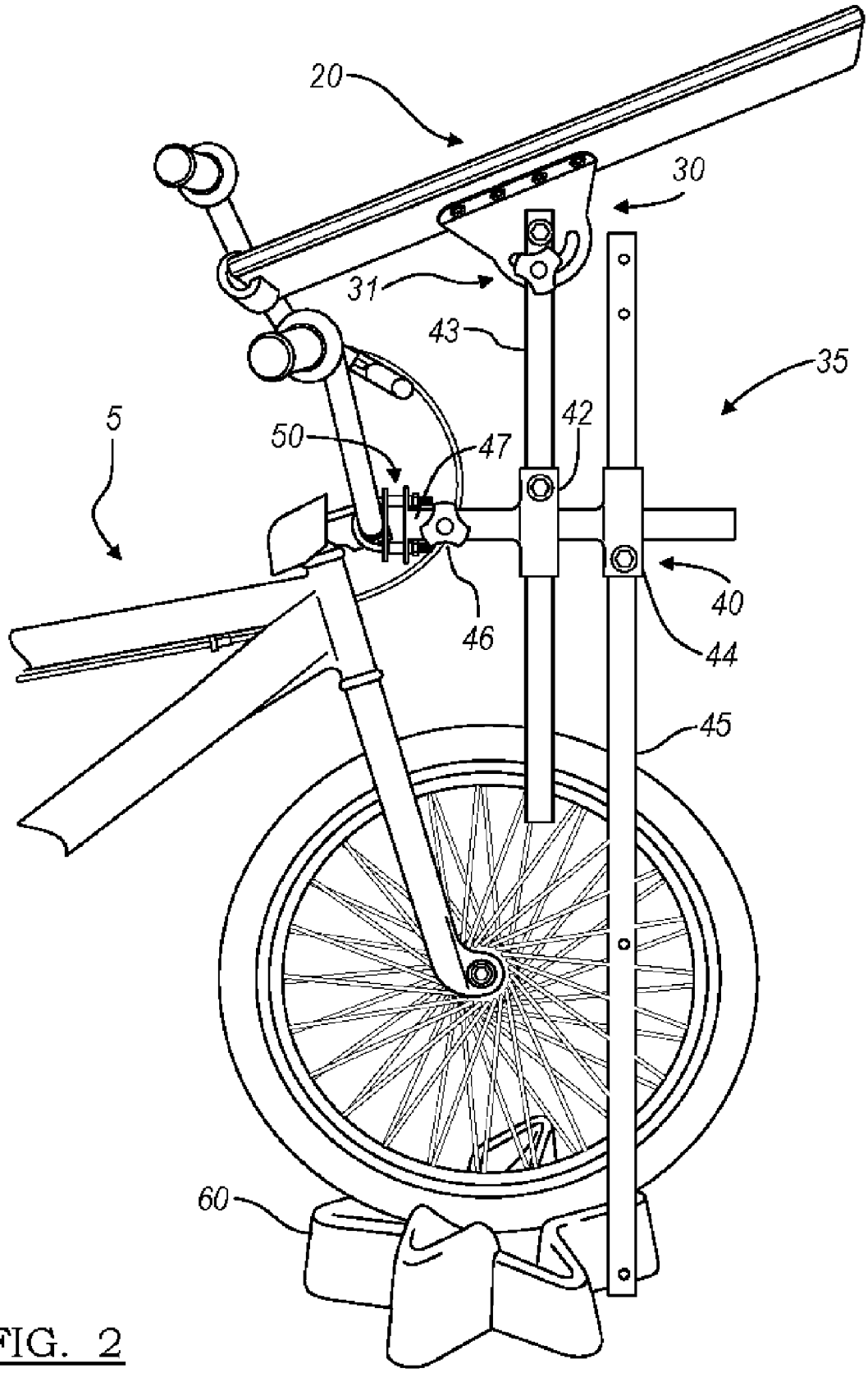
FIG. 2 is a partial side view of the exercise desk according to the principles of the present invention.

With initial reference to FIG. 1, a perspective view of an exercise desk 10, for use with an exercise device 5, according to the principles of the present invention is shown. The exercise desk 10 comprises an orthogonal positioning system 35 for adjusting the vertical and horizontal position of a desk top 20. The system 35 includes an adapter 40 that slidably engages vertical support members 45. The adapter 40 includes a vertical attachment adjustment 44 for selectively adjusting the vertical position of the adapter 40 with respect to the vertical support members 45. Referring now also to FIG. 2, the system 35 further includes a pair of desk top support members 43 which slidably engage the adapter 40. The adapter 40 includes a vertical desk adjustment 42 for selectively adjusting the vertical position of the desk top 20 with respect to the adapter 40 by vertically positioning the desk top support members 43. In the present embodiment, the vertical desk adjustment 42 is a threaded clamp-type locking mechanism.

The vertical support members 45 extend from a base 60. Those skilled in the art will immediately recognize that although a pair of support members 45 is shown, as few as one support member 45 may be employed.

A desk top 20 is selectively pivotally mounted to a pair of desk top support members 43 by a desk mount 30. Those skilled in the art will immediately recognize that although a pair of support members 43 is shown, as few as one support member 43 may be employed. The mount 30 is selectively pivotal, which permits the desk top 20 to pivot about an axis parallel to a horizontal axis of the desk top 20 and includes a pivot locking mechanism 31, which in the present embodiment is a threaded clamp-type locking mechanism. The desk top 20 provides a stable surface for routines not related to exercise, such as, for example, supporting reading and writing materials or a computer.

The orthogonal positioning system 35 further includes a pair of horizontal support members 47. The adapter 40 slidably engages the horizontal support members 47. The adapter 40 includes a horizontal attachment adjustment 46 for selectively adjusting the horizontal position of an attachment member 50, via the adapter 40, with respect to the exercise device 5. In the present embodiment, the horizontal attachment adjustment 46 is a threaded clamp-type locking mechanism.

Those skilled in the art will immediately recognize that although a pair of support members 47 is shown, as few as one support member 47 may be employed. An attachment member 50, extending from the horizontal support member 47, is fixedly attached to the exercise device 5. In the present embodiment, the attachment member 50 is a u-bolt threaded clamp-type locking mechanism attached to a handle bar stem, however, any suitable substitute known in the art may be employed, such as a clevis. Although a threaded clamp-type lock mechanism is disclosed in the immediate embodiment for adjustments 42,44,46 and locking mechanism 31, those skilled in the art will immediately recognize that other types of locking mechanisms may be employed, such as, for example, pins, friction locks and gear locks.

The orthogonal positioning system 35 enables the desk top 20 to be positioned independent of the vertical attachment adjustment setting and horizontal attachment adjustment setting. The adapter 40 vertical desk adjustment 42, vertical attachment adjustment 44 and horizontal attachment adjustment 46 are each independently adjustable, which permits a user to adjust the position of the desk to a variety of exercise devices.

Figure 3:
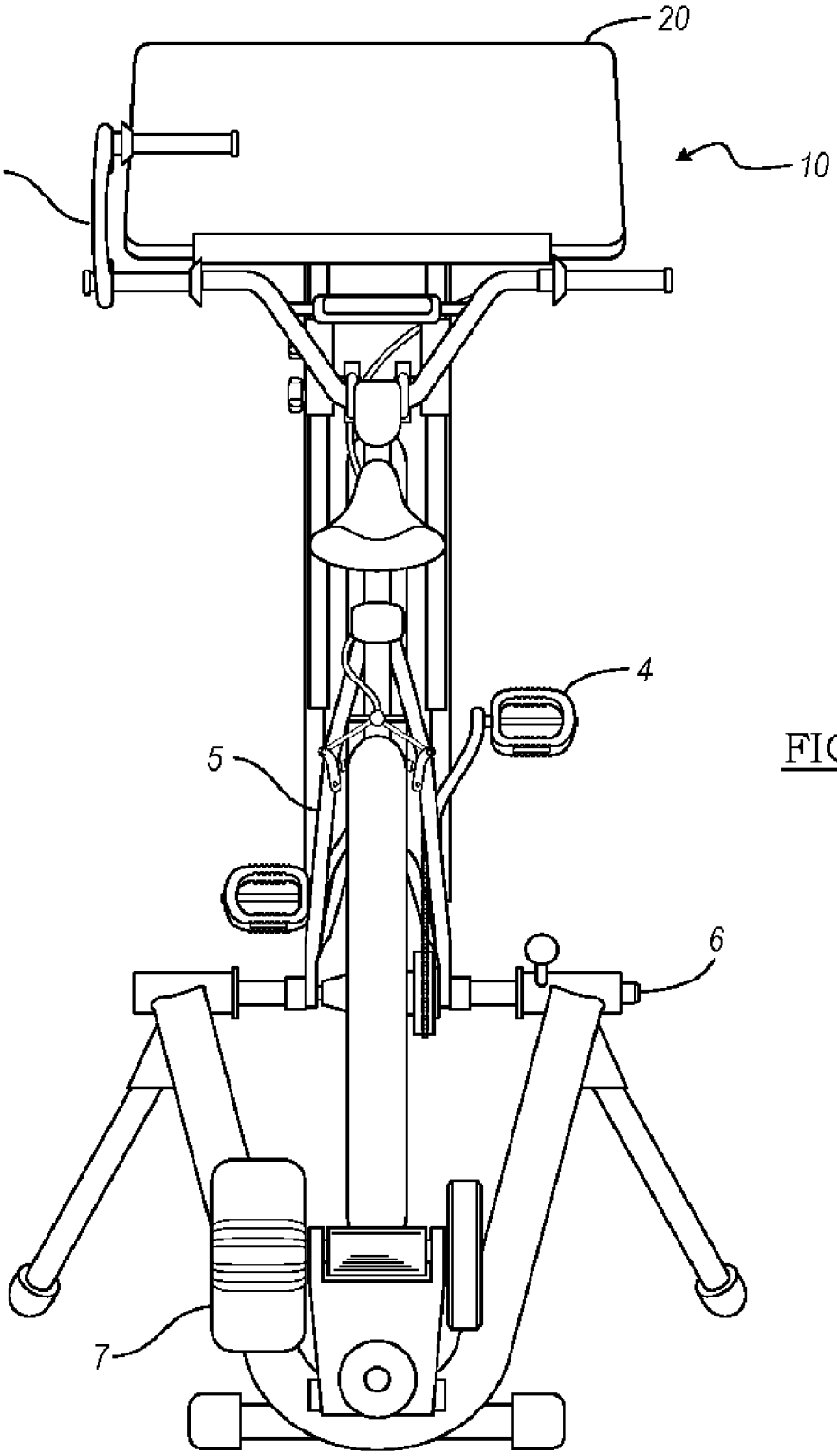
FIG. 3 is a rear view the exercise desk according to the principles of the present invention.

Referring now also to FIG. 3, a rear view of the exercise desk 10 according to the principles of the present invention is shown. A handle 25 is shown adapted to be attached to an exercise device 5. The handle 25 may provide additional support to the user while mounting and dismounting the exercise device 5 as well as while exercising and working.

In the immediate embodiment, the exercise device 5 is a bicycle. One advantage of the present invention is that it may be employed with a non-stationary bicycle, as shown. As such, the exercise desk 10 may further include a load device 7 for applying a load to the user. As the user applies a force to pedals 4 attached to a crank 3, rotatably supported by a frame 2. Torque from the crank 8 is transferred through a chain 3 to a rear wheel 9. The load device 7 includes a rear wheel support 6 to maintain a clearance between the rear wheel 9 and support surface. The load device 7 provides resistance to the rear wheel 9, which is transferred as a reaction force to the pedals 4 by the user. Additionally, the bicycle may be supported further under a front wheel by the base 60. As may be seen in FIGS. 1 and 2, the front wheel seats in the base 60, while the base 60 had width to add lateral support to the bicycle.

Figure 4:
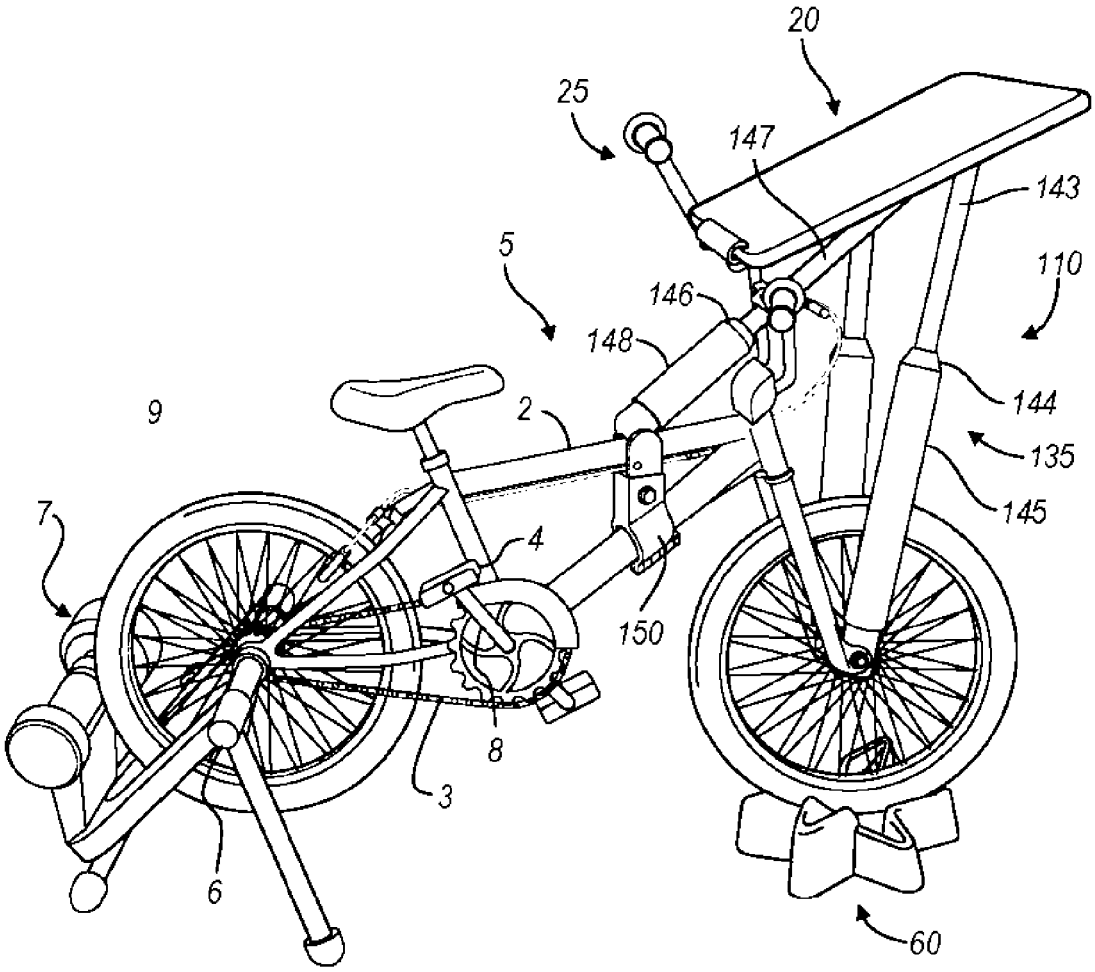
FIG. 4 is a perspective view of an alternate embodiment of the exercise desk according to the principles of the present invention.

Referring now to FIG. 4, a perspective view of an alternate embodiment of an exercise desk according to the principles of the present invention is shown. An exercise desk 110 comprises a triangular positioning system 135 for adjusting the vertical and horizontal position of a desk top 20. The system 135 includes at least one generally vertical support member 145 that slidably engages a vertical desk top support member 143. Although a pair of support members 145 is shown attached to the front axle of the exercise device 5, those skilled in the art will appreciate that the support members 145 may be attached to the base 160 as well as the frame 2 or handlebar stem. A vertical attachment adjustment 144 provides selective adjustment of the position of the desk top 20 along the log axis of the support member 145.

The system 135 further includes an inclined support member 148 which slidably engages the inclined desk top support member 147. Support member 148 is mounted to the frame 2 via a clamp or clevis type attachment member 150. Those skilled in the art will immediately recognize that attachment member 150 may be located at one of several locations on exercise device 5. A vertical attachment adjustment 146 provides selective adjustment of the position of the desk top 20 along the axis of the inclined support member 148. Although not shown, the inclined support member 147 pivotally engages support member 143. A selectively pivotal mount that includes a pivot lock, such as the mount 30 shown in FIG. 2, permits the desk top 20 to pivot about an axis. The selectively pivotal mount is pivotally mounted to support member 147, support member 143 or both members 147 and 143 if attached at the intersection of members 143 and 147.

In the preferred embodiment, adjustments 146 and 142 are twist-style friction locks, however those skilled in the art will immediately recognize that threaded clamp-type lock mechanisms, pins, other types of friction locks and gear locks may be employed.

Although in the preferred embodiment the exercise desk is incorporated with a bicycle 5, the invention is contemplated to be employed with a number of other exercise devices, such as treadmills, ski machines, calf machines or any other device which would permit a user to study while exercising.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

What is claimed is:

1. An exercise desk for attaching to an exercise device the exercise desk, comprising:

a base and a rear wheel support device, said exercise desk adapted to support a non-stationary bicycle, said base adapted to support a front wheel of the non-stationary bicycle and said rear wheel support device adapted to support a rear wheel of the non-stationary bicycle;

a desk top providing a stable surface;

a selectively pivotable desk mount fixedly attached to said desk top to permit said desk top to pivot about an axis; and an orthogonal desk top positioning system, adapted to adjustably attach said desk top to a non-stationary bicycle, having an adapter including a vertical desk adjustment lock, a horizontal attachment adjustment lock, and a vertical attachment adjustment lock, at least one desk top support member attached to said desk mount, said desk top support member, slidably engaging said adapter, is adjustable by said vertical desk adjustment lock, and at least one vertical support member extending from said base, said vertical support member, slidably engaging said adapter, is adjustable by said vertical attachment adjustment lock and at least one horizontal support member, slidably engaging said adapter, is adjustable by said horizontal attachment adjustment lock, said horizontal support member being attachable to a non-stationary bicycle said positioning system permitting horizontal and vertical adjustment of said adapter while providing independent adjustment of said desk top, wherein the vertical position of said adapter is adjustable independent of the horizontal position of the adapter.

2. An exercise desk for attaching to an exercise device the exercise desk, comprising:

a base and a rear wheel support device, said exercise desk adapted to support a non-stationary bicycle, said base adapted to support a front wheel of the non-stationary bicycle and said rear wheel support device adapted to support a rear wheel of the non-stationary bicycle;

a desk top providing a stable surface;

a selectively pivotable desk mount fixedly attached to said desk top to permit said desk top to pivot about an axis; and an orthogonal desk top positioning system, adapted to adjustably attach said desk top to a non-stationary bicycle, having an adapter including a vertical desk adjustment lock, a horizontal attachment adjustment lock, and a vertical attachment adjustment lock, at least one desk top support member attached to said desk mount, said desk top support member, slidably engaging said adapter, is adjustable by said vertical desk adjustment lock, and at least one vertical support member extending from said base, said vertical support member, slidably engaging said adapter, is adjustable by said vertical attachment adjustment lock and at least one horizontal support member, slidably engaging said adapter, is adjustable by said horizontal attachment adjustment lock, said horizontal support member being attachable to a non-stationary bicycle said positioning system permitting horizontal and vertical adjustment of said adapter while providing independent adjustment of said desk top, wherein the vertical position of said desk top may be adjusted independent of the vertical position of the adapter.

* * * * *